United States Patent [19]

Hicks

[11] Patent Number: 4,875,800

[45] Date of Patent: Oct. 24, 1989

[54] TEMPORARY SUPPORT SURFACES FOR USE ON MUDDY OR MARSHY LAND AREAS

[75] Inventor: Gary D. Hicks, Sugarland, Tex.

[73] Assignee: Way Construction, Inc., Stowell, Tex.

[21] Appl. No.: 147,300

[22] Filed: Jan. 22, 1988

[51] Int. Cl.[4] ..... E01C 5/14; E01C 9/08

[52] U.S. Cl. ..... 404/35; 404/46

[58] Field of Search ..... 404/34–36, 404/40, 41, 46; 52/581; 108/53.1, 53.3, 53.5, 57.1; 238/10 R

[56] References Cited

U.S. PATENT DOCUMENTS

| | | | |
|---|---|---|---|
| 112,239 | 2/1871 | Grant | 404/40 X |
| 1,233,200 | 7/1917 | Dessau | 404/41 X |
| 1,970,037 | 8/1934 | Fischer | 404/46 X |
| 2,450,432 | 10/1948 | Lehrman | 108/57.1 |
| 2,639,650 | 5/1953 | Robishaw | 404/35 |
| 2,652,753 | 9/1953 | Smith | 404/41 |
| 2,819,026 | 1/1958 | Leyendecker | 404/41 X |
| 2,912,909 | 11/1959 | Hart | 404/36 |
| 2,950,078 | 8/1960 | Phillips | 108/53.1 |
| 3,855,945 | 12/1974 | Sebilleau et al. | 108/57.1 |
| 4,184,435 | 1/1980 | Shevchenko | 108/57.1 |
| 4,289,420 | 9/1981 | Davis et al. | 52/581 X |
| 4,462,712 | 7/1984 | Penland, Sr. | 404/46 X |
| 4,600,336 | 7/1986 | Waller, Jr. | 404/46 X |
| 4,600,337 | 7/1986 | Sarver | 404/46 X |

FOREIGN PATENT DOCUMENTS

| | | | |
|---|---|---|---|
| 637394 | 9/1963 | Belgium | 404/41 |
| 483766 | 8/1953 | Italy | 404/41 |

*Primary Examiner*—Bruce M. Kisliuk
*Assistant Examiner*—Matthew Smith
*Attorney, Agent, or Firm*—Burns, Doane, Swecker & Mathis

[57] ABSTRACT

A temporary support structure for use on muddy or marshy land areas comprises a plurality of panels. Each panel includes a first row of boards arranged in parallel side-by-side relationship, and a second row of boards arranged in parallel side-by-side relationship. The second row of boards is superimposed on the first row of boards and oriented perpendicularly thereto. A first plurality of panels defines a lower layer in which the second row of boards extends upwardly to define lower locking boards. A second plurality of panels defines an upper layer resting upon the lower layer wherein the second row of boards thereof extends downwardly to define upper locking boards intermeshed with the lower locking boards. Individual panels of the upper layer are intermeshed with a plurality of lower panels to create an interlocking relationship therewith.

19 Claims, 3 Drawing Sheets

12
W
G
12U
14
18
16
16
20
20
20
20
22
24
16
W
G
16
20L
20L
20E
D
12
12L
14

20U
16U
10
20L
16L

10
WS
UL
12
20U
12U
16U
20L
LL
12L
16L
12

TEMPORARY SUPPORT SURFACES FOR USE ON MUDDY OR MARSHY LAND AREAS

BACKGROUND OF THE INVENTION

The present invention relates to temporary support surfaces such as floors and roadways, for example, which can be placed on muddy or marshy areas to support various operations such as oil or gas well drilling.

Temporary support surfaces of that type are conventional and are described, for example, in U.S. Patents No. 2,819,026, No. 4,462,712, and No. 4,600,336. In Patent No. 4,462,712 a plurality of panels are interconnected. Each panel comprises a base section formed of a plurality of parallel first boards, and a surface section formed of a plurality of parallel second boards nailed to the first boards to extend in a direction perpendicular thereto. Some of the second boards extend beyond one side of the panel to define locking tabs and locking slots 32. Adjacent panels are joined by inserting the locking tabs of one panel into the locking slots of another panel. In such an arrangement, the intermeshing of the tabs and slots is sufficient to secure the panels together.

In Patent No. 4,600,336, a three-tier panel is employed wherein tabs or slots are disposed on both sides thereof. Thus, each side of the panel can be connected to another panel. A tie-in plank is nailed to two adjoining panels in order to maintain the connection therebetween.

It would be desirable to provide a temporary support structure which comprises panels that can be interlocked without the need for laterally projecting tabs which can be easily broken off.

Also, it would be desirable to eliminate the need to employ fasteners, such as nails, to interconnect adjoining panels, to eliminate not only the cost of the nails but also the time and effort required to insert and remove the nails.

SUMMARY OF THE INVENTION

The present invention relates to a temporary support structure for use on muddy or marshy land areas. The support structure comprises a plurality of panels. Each panel includes a first tier and a second tier disposed in superimposed relation to the first tier. The second tier comprises a row of boards arranged in side-by-side relationship and fixedly connected to the first tier. The boards are spaced apart to define gaps therebetween. A first plurality of the panels is positioned to define a lower layer of panels in which the first tier thereof rests upon the ground and the row of boards thereof extends upwardly to define lower locking boards. A second plurality of the panels is positioned to define an upper layer of panels resting upon the lower layer of panels. The panels of the upper layer are arranged such that the first tier thereof faces upwardly to define a working surface, and the row of boards thereof extends downwardly to define upper locking boards disposed parallel to the lower locking boards. The upper locking boards are disposed loosely in the gaps defined between the lower locking boards, and the lower locking boards are disposed loosely in gaps defined between upper locking boards.

Preferably, panels of the upper layer are arranged in overlapping relationship to panels of the lower layer such that individual panels of the upper layer have locking boards disposed in gaps defined by more than one panel of the lower layer to create an interlocked relationship.

The present invention also envisions steps involved in assembling a support structure of the type described above.

BRIEF DESCRIPTION OF THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
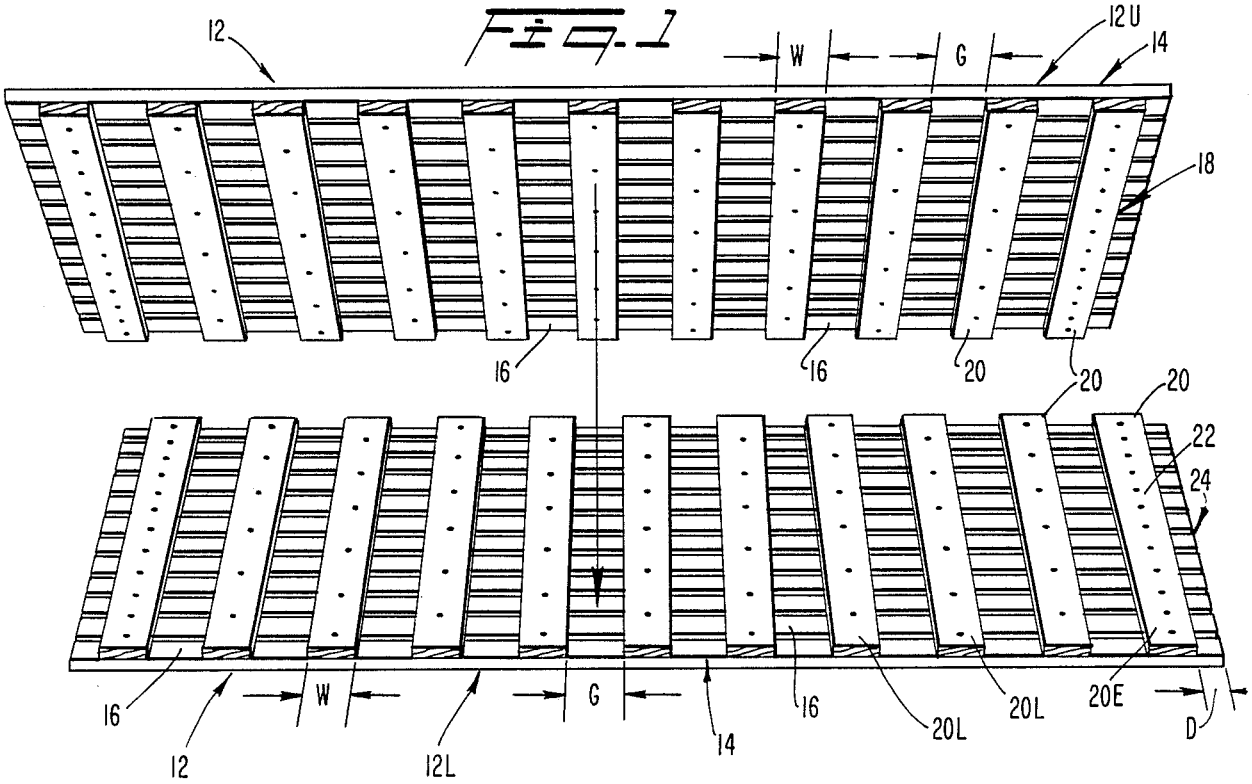
FIG. 1 is an exploded perspective view of the top side of a lower panel and the underside of an upper panels as the upper panel is being laid upon the lower panel.
Figure 2:
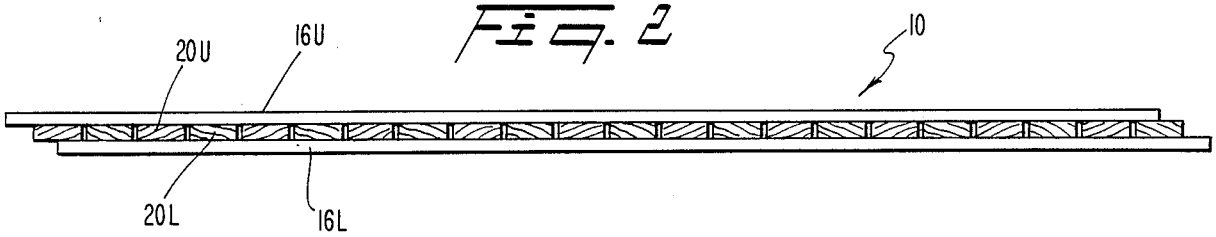
FIG. 2 is an end view of a support structure defined by the upper and lower panels.
Figure 3:
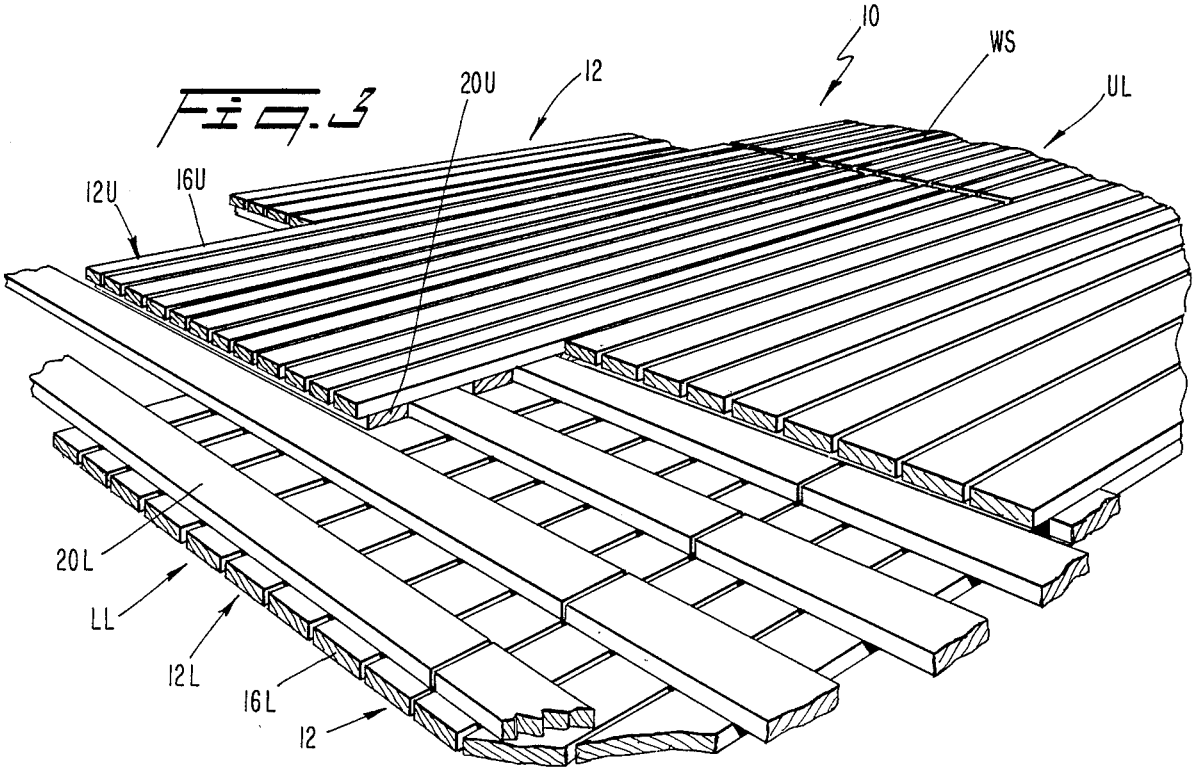
FIG. 3 is a perspective view of a portion of a support structure under construction.

In accordance with the present invention, a temporary flooring structure 10 is formed of a plurality of panels 12. Each panel includes a first tier 14 defined by a first row of rigid boards 16 arranged in parallel and side-by-side relationship. Longitudinal edges of adjacent boards 16 are preferably arranged in abutting or very close relationship.

Attached to the first tier 14 in superimposed relationship therewith is a second tier 18 defined by a second row of rigid boards 20 arranged in parallel and side-by-side relationship. The boards 20 of the second row are oriented perpendicularly relative to the boards 16 of the first row, and the lateral gaps G between the boards 20 of the second tier 18 are at least slightly larger than the width W of the boards 20.

Endmost ones 20E of the boards 20 of the second tier preferably have their longitudinal edges spaced from the adjacent edge 24 of the panel by a distance D equal to about one-half of the gap G.

The boards 20 of the second tier are fixedly secured to the boards 16 of the first tier in any suitable fashion, such as by nails. The boards 20 are connected to the boards 16 of solely its associated panel (i.e., the boards are not connected to other panels), whereby the panels define separately movable units.

To construct a temporary floor, a plurality of the panels 12L is laid upon the ground to define a lower or base layer LL. Those panels define lower or base panels 12L which are positioned such that the first-tier boards 16L thereof rest upon the ground, and the second-tier boards 20L thereof extend upwardly from an upper face of the first tier to define lower locking boards 20L.

Then, a plurality of panels 12 is placed upon the first panels to define an upper layer UP of upper panels 12U. The upper panels of such upper layer are arranged such that the first tier thereof faces upwardly to define a working surface WS, and the boards 20U of the second tier extend downwardly from a lower face of the first tier to define upper locking boards 20U. The first or upwardly facing tiers of successive panels of the upper layer are disposed in substantially end-to-end relationship, i.e., so as to enable works to safely walk from one upper panel to another.

The upper locking boards 20U are oriented parallel to the lower locking boards 20L and are disposed loosely in the gaps G defined between the lower locking boards 20L. In similar fashion, the lower locking boards 20L are disposed loosely in the gaps G defined between the upper locking boards 20U. By "loosely" is meant that sufficient clearance is formed between the adjacent longitudinal edges of the locking boards to enable the upper panels to be easily inserted into, and removed from, the lower panels.

The panels 12U of the upper layer UL are oriented in overlapping relationship to the panels of the lower layer. That is, individual upper panels 12U have locking boards 20U disposed in gaps G of more than one lower panel 20L to create an interlocked relationship between the panels.

Figure 5:
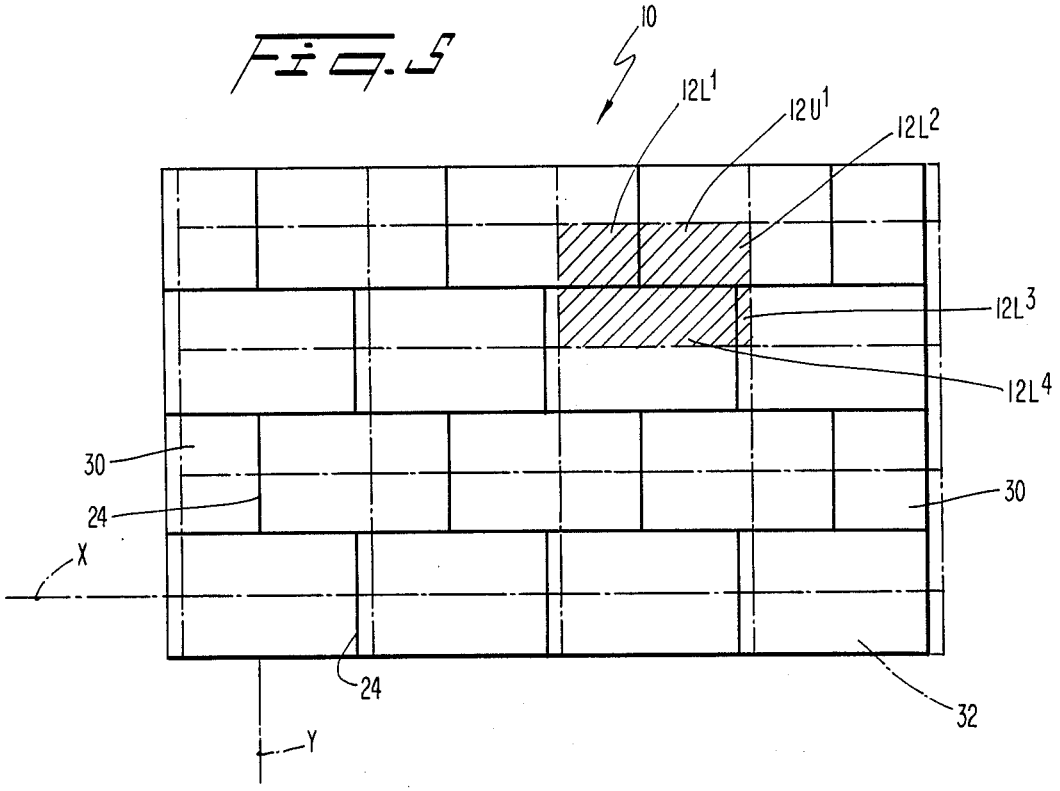
FIG. 5 is a schematic plan view of a support structure, with the lower panels thereof represented by solid lines, and the upper panels thereof represented by broken lines.

One possible overlapping pattern is depicted in FIG. 5 wherein the lower panels 12L are represented by solid lines, and the upper panels 12U are represented by broken lines. It will be appreciated that most upper panels 12U overlap more than one lower panel. For example, the upper panel 12U' overlaps four lower panels $12L^1$, $12L^2$, $12L^3$, $12L^4$ in the shaded region of FIG. 5. Other ones of the upper panels may overlap four or less of the lower panels.

In particular, the lower panels 12L are arranged such that the lower locking boards 20L are aligned along one axis of the floor, e.g., the *x* axis in FIG. 5, so as to form parallel rows of lower panels extending along or parallel to that axis. Furthermore, the panels of adjacent lower rows are staggered along the other axis of the floor, i.e., the *Y* axis. In other words, the edges 24 of the lower panels extending along the *y* axis are not aligned with corresponding edges 24 of an adjacent lower row. The upper panels 12U are then placed upon the lower panels 12L such that most of the upper panels 12U overlap a plurality of lower panels. In order to form a rectangle, some of the lower panels, e.g., the endmost lower panels 30 of alternating rows are of reduced length. Also, some of the upper panels, e.g., the two outermost rows 32 thereof, are of reduced width.

It is apparent from FIG. 5 that the upper and lower panels define upper and lower layers, respectively, of substantially the same rectangular size and shape, with the upper layer being slightly offset in the *x* axis.

It will be appreciated that the staggering of the bottom rows and the overlapping of a plurality of lower panels by most upper panels produces an effective interlocking of all upper and lower panels into an integral support structure.

Figure 4:
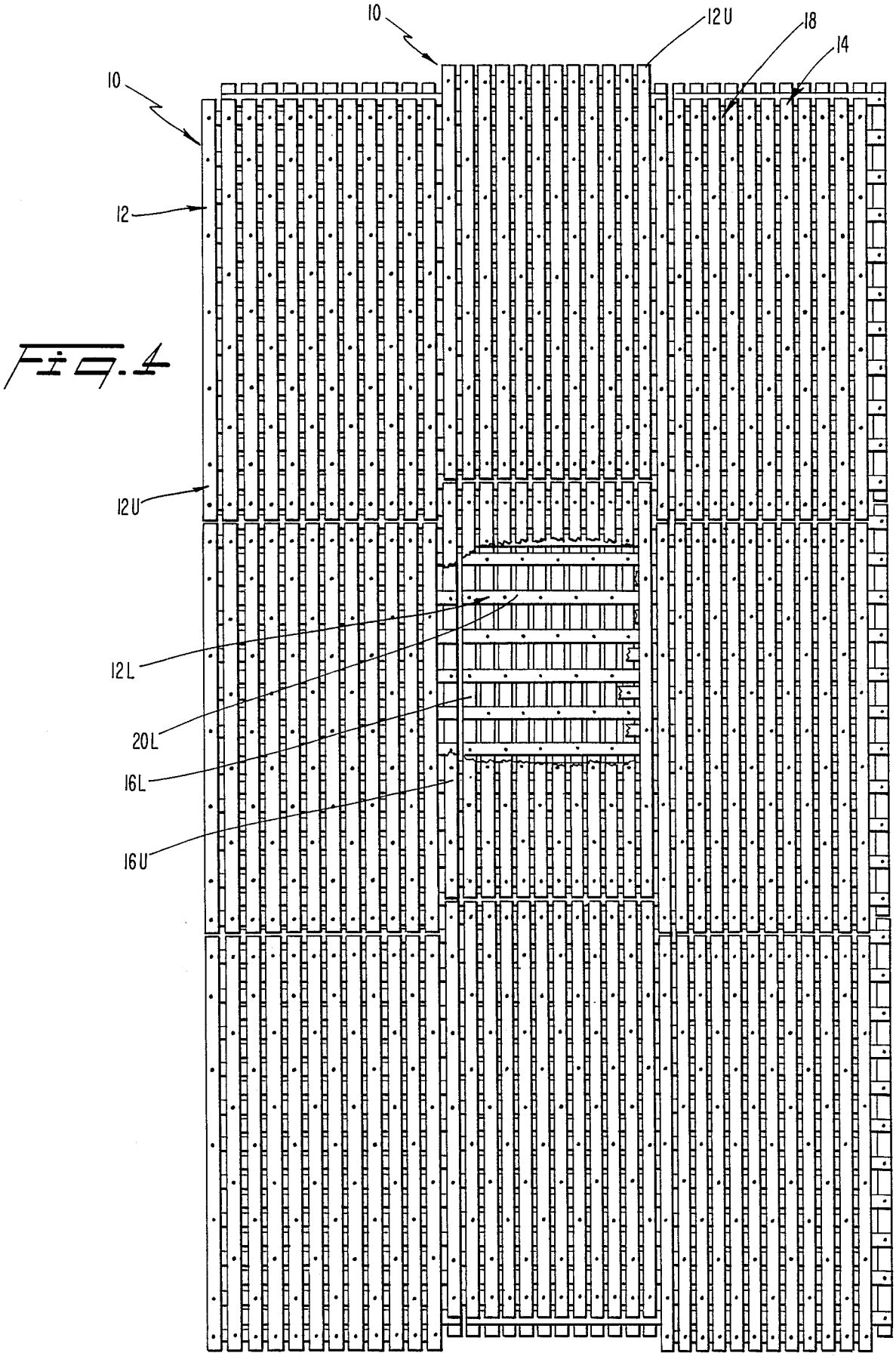
FIG. 4 is a plan view of a support surface with a portion of the upper layer thereof broken away.

Of course, the interlocking of the panels could be accomplished in other ways, such as by staggering the upper panels 12U as depicted in FIG. 4.

Figure 6:
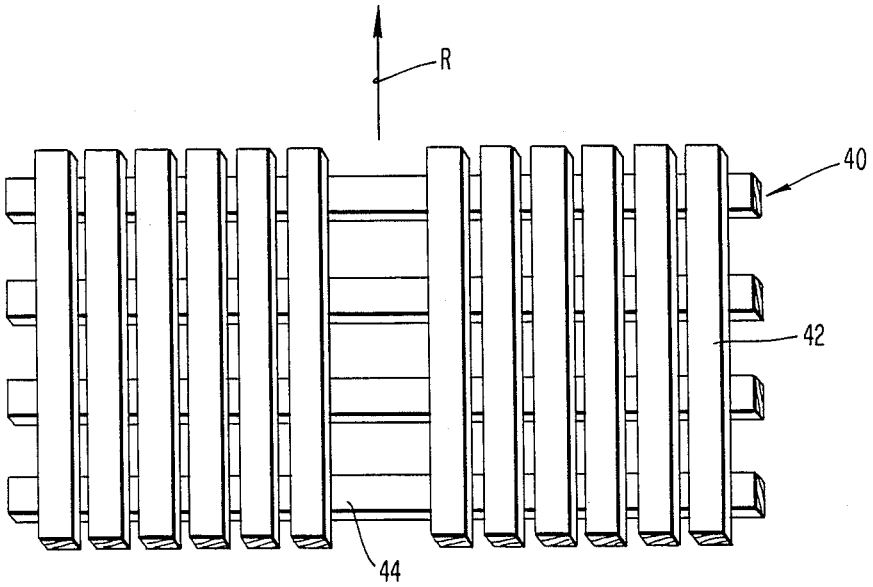
FIG. 6 is a top perspective view of a modified form of upper panel utilized in the construction of a roadway. cl

In some cases it is desirable to form a temporary roadway of panels for supporting vehicle travel thereon. In such a case, there can be formed a row of lower panels, the row extending in the direction R of the roadway. The lower locking boards would be oriented perpendicular to such direction. The upper panels 40 (FIG. 6) would be configured differently than those previously described in that the boards 42 defining the working surface are arranged in two spaced apart groups. The boards 42 of each such group extend in the direction of the roadway, i.e., in the direction of vehicle travel and would support respective wheels of a vehicle. The upper locking boards 44 extend perpendicularly to the direction R and would mesh with the lower locking boards (not shown). Each upper panel 40 would overlap two lower panels to create an interlocking relationship.

In accordance with the present invention, a temporary support structure can be created by means of panels which avoid the need for laterally projecting tabs which could otherwise be broken off. Furthermore, the unique interlocking relationship between the panels eliminate the need to employ fasteners, such as nails to interconnect adjoining panels together.

Although the present invention has been described in connection with preferred embodiments thereof, it will be appreciated by those skilled in the art that additions, substitutions, modifications, and deletions not specifically described may be made without departing from the spirit and scope of the invention as defined in the appended claims.

What is claimed is:

1. A temporary support structure for use on muddy or marshy land areas, said support structure comprising:

a plurality of panels, each panel including a rigid first tier and a second tier disposed in superimposed relation to said first tier, said second tier comprising a row of rigid boards arranged in side-by-side relationship and fixedly connected to said first tier, at least some of said boards spaced apart to define locking gaps therebetween, said boards being connected to said first tier of solely its respective panel so that said panels define separately movable units, a first plurality of said panels positioned to define a lower layer of panels in which said first tier thereof rests upon the ground and said row of boards thereof extends upwardly to define lower locking boards, a second plurality of said panels positioned to define an upper layer of panels disposed upon said lower layer of panels, said panels of said upper layer arranged such that said first tiers thereof face upwardly to define a working surface, and said rows of boards thereof extend downwardly to define upper locking boards disposed parallel to said lower locking boards, said first tiers of successively arranged panels of said upper layer being disposed in substantially end-to-end relationship, said upper locking boards disposed loosely in said locking gaps defined between said lower locking boards, said lower locking boards disposed loosely in said locking gaps defined between said upper locking boards.

2. A temporary support structure according to claim 1, wherein panels of said upper layer are arranged in overlapping relationship to panels of said lower layer such that individual panels of said upper layer have locking boards disposed in gaps defined by more than one panel of said lower layer to create an interlocked relationship.

3. A temporary support structure according to claim 2, wherein some of said upper panels overlap four said lower panels.

4. A temporary support structure according to claim 3, wherein said lower panels are arranged in parallel rows with said lower locking boards disposed in mutual alignment in each said row.

5. A temporary support structure according to claim 4, wherein said lower panels of adjacent rows thereof are disposed in staggered relationship.

6. A temporary support structure according to claim 2, wherein said lower panels are arranged in parallel rows with said lower locking boards disposed in mutual alignment in each said row, said lower panels of adjacent rows thereof being disposed in staggered relationship, some of said upper panels overlapping four said lower panels.

7. A temporary support structure according to claim 1, wherein said first tier comprises a row of parallel boards oriented transversely relative to said boards of said second tier.

8. A temporary support structure according to claim 7, wherein said boards of said first tier are oriented perpendicularly relative to said boards of said second tier.

9. A temporary support structure according to claim 7, wherein gaps between said boards of said first tier are smaller than said gaps between said boards of said second tier.

10. A temporary support structure according to claim 7, wherein said boards of said first and second tiers are formed of wood.

11. A temporary support structure according to claim 1, wherein said boards of said second tier are parallel to one another.

12. A temporary support structure according to claim 1, wherein said gaps are wider than said locking boards disposed therein.

13. A temporary support structure for use on muddy or marshy land areas, said support structure comprising:

a plurality of panels, each panel including a first row of rigid wooden boards arranged in parallel and side-by-side relationship, and a second row of rigid wooden boards arranged in parallel and side-by-side relationship, said second row of boards being superimposed relative to said first row of boards and rigidly connected thereto, said boards of said second row extending perpendicularly relative to said boards of said first row and at least some of said boards of said second row being spaced apart to define locking gaps therebetween, said boards of said second row spaced apart farther than said boards of said first row, said second row of boards being connected to said first row of boards of solely its respective panel so that said panels define separately movable units, a first plurality of said panels positioned to define a lower layer of panels in which said first row of boards thereof rests upon the ground, and said second row of boards thereof faces upwardly to define lower locking boards, a second plurality of said panels positioned to define an upper layer of panels resting upon said lower layer of panels, said panels of said upper layer arranged such that said first rows of boards thereof face upwardly to define a working surface, and said second rows of boards thereof face downwardly to define upper locking boards disposed parallel to said lower locking boards, said first rows of boards of successively arranged panels of said upper layer being disposed in substantially end-to-end relationship, said upper locking boards oriented parallel to said lower locking boards and disposed loosely in said locking gaps defined between said lower locking boards, said lower locking boards disposed loosely in said locking gaps defined between said upper locking boards, panels of said upper layer arranged in overlapping relationship to panels of said lower layer such that individual panels of said upper layer have locking boards disposed in locking gaps defined by more than one panel of said lower layer to create an interlocked relationship.

14. A temporary support structure according to claim 13, wherein said gaps are wider than said locking boards disposed therein.

15. A temporary support structure according to claim 14, wherein said lower panels are arranged in parallel rows with said lower locking boards disposed in mutual alignment in each said row, said lower panels of adjacent rows being disposed in staggered relationship, some of said upper panels overlapping four said lower panels.

16. A method of forming a temporary support structure to define a working surface on muddy or marshy land areas, said method comprising the steps of:

providing a plurality of panels, each of which panels including a first tier and a second tier disposed in superimposed relation to said first tier, said second tier comprising a row of rigid boards arranged in side-by-side relationship and fixedly connected to said first tier, at least some of said boards spaced apart to define locking gaps therebetween, arranging a first plurality of said panels as a lower layer of panels in which said first tier thereof rests upon the ground and said row of boards thereof faces upwardly to define lower locking boards, and arranging a second plurality of said panels as an upper layer of upper panels disposed upon said lower layer of lower panels, such that:

said first tier of said upper panels faces upwardly to define a working surface, and said rows of boards thereof face downwardly to define upper locking boards disposed parallel to said lower locking boards, and said first tiers of successively arranged panels of said upper layer disposed in substantially end-to-end relationship, said upper locking boards are disposed loosely in said locking gaps defined between said lower locking boards, said lower locking boards disposed loosely in said locking gaps defined between said upper boards.

17. A method according to claim 16, wherein panels of said upper layer are placed in overlapping relationship to panels of said lower layer such that individual panels of said upper layer have their locking boards disposed in gaps defined by more than one panel of said lower layer to create an interlocked relationship.

18. A method according to claim 16, wherein said first-named arranging step comprises arranging said lower panels into parallel rows in which said lower locking boards of each row are aligned, and wherein said lower panels of adjacent rows are in staggered relationship.

19. A method according to claim 18, wherein said second-named arranging step includes arranging some of said upper panels in overlapping relationship to form said lower panels.

* * * * *